US007022451B2

(12) United States Patent
Kinoshita

(10) Patent No.: US 7,022,451 B2
(45) Date of Patent: Apr. 4, 2006

(54) METHOD OF COATING A CYLINDRICAL PHOTOCONDUCTIVE ELEMENT FOR AN ELECTROPHOTOGRAPHIC IMAGE FORMING APPARATUS AND APPARATUS FOR THE SAME

(75) Inventor: Takehiko Kinoshita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/019,789

(22) Filed: Dec. 22, 2004

(65) Prior Publication Data

US 2005/0112288 A1 May 26, 2005

Related U.S. Application Data

(62) Division of application No. 10/087,726, filed on Mar. 1, 2002, now Pat. No. 6,852,166.

(30) Foreign Application Priority Data

Mar. 2, 2001 (JP) ..... 2001-058786
Jan. 25, 2002 (JP) ..... 2002-017500

(51) Int. Cl.
*G03G 5/00* (2006.01)
*B05C 19/02* (2006.01)

(52) U.S. Cl. ..... 430/127; 430/133; 427/430.1; 118/423; 118/412; 118/63; 118/64

(58) Field of Classification Search ..... 430/127, 430/133; 427/430.1; 118/423, 412, 63, 118/64

See application file for complete search history.

(56) References Cited

U.S. PATENT DOCUMENTS 6,010,572 A 1/2000 Furusawa et al.

FOREIGN PATENT DOCUMENTS

| | | |
|---|---|---|
| JP | 6307873 | 1/1988 |
| JP | 5241355 | 9/1993 |
| JP | 7144164 | 6/1995 |

*Primary Examiner*—Mark A. Chapman
(74) *Attorney, Agent, or Firm*—Cooper & Dunham LLP

(57) ABSTRACT

A method of coating a photoconductive element for an electrophotographic image forming-apparatus and an apparatus therefore are disclosed. A plurality of cylindrical bodies are immersed in a bath, which stores a coating liquid, at the same time and then lifted out of the bath. As a result, a photoconductive film is formed on each cylindrical body.

7 Claims, 15 Drawing Sheets

FIG.13

| | D1/mm | D2/mm |
|---|---|---|
| EXAMPLE 1-1 | 0 | 0 |
| EXAMPLE 1-2 | 20 | 0 |
| EXAMPLE 1-3 | 50 | 0 |
| EXAMPLE 1-4 | 100 | 0 |
| EXAMPLE 1-5 | 20 | 5 |
| EXAMPLE 1-6 | 20 | 25 |
| EXAMPLE 1-7 | 20 | 50 |
| EXAMPLE 1-8 | 20 | 60 |
| COMPARATIVE EXAMPLE 1-1 | -10 | 0 |
| COMPARATIVE EXAMPLE 1-2 | -30 | 0 |

FIG.14

| | DIFFERENCE R(μm) BETWEEN MAX. & MIN. | | | THICKNESS DISTRIBUTION | DEGREE OF SLOPE (50mm~290mm) FILM THICKNESS | IMAGE ESTIMATION | |
|---|---|---|---|---|---|---|---|
| | DISTANCE FROM TOP | | | | | | |
| | 50mm | 170mm | 290mm | | | TRIMMED IMAGE | HALFTONE IMAGE |
| EXAMPLE 1-1 | 0.15 | 0.45 | 1.23 | SLOPE IN AXIAL DIRECTION | 3.2 μm | ○ | ○ |
| EXAMPLE 1-2 | 0.11 | 0.33 | 0.53 | SLOPE IN AXIAL DIRECTION | 3.1 μm | ○ | ○ |
| EXAMPLE 1-3 | 0.09 | 0.33 | 0.22 | SLOPE IN AXIAL DIRECTION | 3.5 μm | ○ | ○ |
| EXAMPLE 1-4 | 0.08 | 0.15 | 0.28 | SLOPE IN AXIAL DIRECTION | 3.4 μm | ○ | ○ |
| EXAMPLE 1-5 | 0.09 | 0.12 | 0.23 | NO SLOPE | 0.3 μm | ○ | ○ |
| EXAMPLE 1-6 | 0.12 | 0.19 | 0.25 | NO SLOPE | 0.2 μm | ○ | ○ |
| EXAMPLE 1-7 | 0.43 | 0.33 | 0.28 | NO SLOPE | 0.3 μm | ○ | ○ |
| EXAMPLE 1-8 | 1.29 | 0.75 | 0.25 | NO SLOPE | 0.3 μm | ○ | ○ |
| COMPARATIVE EXAMPLE 1-1 | 0.13 | 0.73 | 2.3 | SLOPE IN AXIAL DIRECTION | 8.2 μm | SHEAR AT TOP | IRREGULAR DENSITY AT BOTTOM |
| COMPARATIVE EXAMPLE 1-2 | 0.22 | 1.58 | 3.1 | SLOPE IN AXIAL DIRECTION | 9.1 μm | SHEAR AT TOP | IRREGULAR DENSITY FROM CENTER TO BOTTOM |

FIG.15

| | DIFFERENCE R(μm) BETWEEN MAX. & MIN. | | | THICKNESS DISTRIBUTION | DEGREE OF SLOPE (50mm~290mm) FILM THICKNESS | IMAGE ESTIMATION | |
|---|---|---|---|---|---|---|---|
| | DISTANCE FROM TOP | | | | | | |
| | 50mm | 170mm | 290mm | | | TRIMMED IMAGE | HALFTONE IMAGE |
| EXAMPLE 2-1 | 0.35 | 0.55 | 2.16 | SLOPE IN AXIAL DIRECTION | 5.2 μm | ○ | IRREGULAR DENSITY AT BOTTOM |
| EXAMPLE 2-2 | 0.44 | 0.57 | 1.62 | SLOPE IN AXIAL DIRECTION | 4.8 μm | ○ | LIGHT IRREGULAR DENSITY AT BOTTOM |
| EXAMPLE 2-3 | 0.47 | 0.62 | 1.58 | SLOPE IN AXIAL DIRECTION | 4.6 μm | SHEAR AT TOP | LIGHT IRREGULAR DENSITY AT BOTTOM |
| EXAMPLE 2-4 | 0.53 | 0.57 | 1.55 | SLOPE IN AXIAL DIRECTION | 4.9 μm | ○ | LIGHT IRREGULAR DENSITY AT BOTTOM |
| EXAMPLE 2-5 | 0.44 | 0.58 | 1.73 | NO SLOPE | 2.2 μm | ○ | LIGHT IRREGULAR DENSITY AT BOTTOM |
| EXAMPLE 2-6 | 1.59 | 0.73 | 0.25 | NO SLOPE | 2.3 μm | ○ | LIGHT IRREGULAR DENSITY AT BOTTOM |
| EXAMPLE 2-7 | 1.73 | 0.33 | 0.28 | NO SLOPE | 1.9 μm | ○ | LIGHT IRREGULAR DENSITY AT BOTTOM |
| EXAMPLE 2-8 | 2.5 | 1.2 | 0.53 | NO SLOPE | 2.7 μm | ○ | HEAVY IRREGULAR DENSITY FROM TOP TO CENTER |

FIG.16

| | DIFFERENCE R(μm) BETWEEN MAX. & MIN. | | | THICKNESS DISTRIBUTION | DEGREE OF SLOPE (50mm～290mm) FILM THICKNESS | IMAGE ESTIMATION | |
|---|---|---|---|---|---|---|---|
| | DISTANCE FROM TOP | | | | | | |
| | 50mm | 170mm | 290mm | | | TRIMMED IMAGE | HALFTONE IMAGE |
| EXAMPLE 3-1 | 0.13 | 0.23 | 1.23 | SLOPE IN AXIAL DIRECTION | 2.9 μm | ○ | ○ |
| EXAMPLE 3-2 | 0.11 | 0.22 | 0.49 | SLOPE IN AXIAL DIRECTION | 3.1 μm | ○ | ○ |
| EXAMPLE 3-3 | 0.11 | 0.17 | 0.22 | SLOPE IN AXIAL DIRECTION | 2.8 μm | ○ | ○ |
| EXAMPLE 3-4 | 0.12 | 0.12 | 0.28 | SLOPE IN AXIAL DIRECTION | 2.9 μm | ○ | ○ |
| EXAMPLE 3-5 | 0.09 | 0.16 | 0.3 | NO SLOPE | 0.9 μm | ○ | ○ |
| EXAMPLE 3-6 | 0.1 | 0.22 | 0.29 | NO SLOPE | 0.7 μm | ○ | ○ |
| EXAMPLE 3-7 | 0.38 | 0.35 | 0.3 | NO SLOPE | 0.6 μm | ○ | ○ |
| EXAMPLE 3-8 | 0.43 | 0.37 | 0.25 | NO SLOPE | 0.7 μm | ○ | ○ |

METHOD OF COATING A CYLINDRICAL PHOTOCONDUCTIVE ELEMENT FOR AN ELECTROPHOTOGRAPHIC IMAGE FORMING APPARATUS AND APPARATUS FOR THE SAME

CROSS-REFERENCE TO RELATED APPLICATIONS

This application is a divisional of U.S. Ser. No. 10/087,726, filed Mar. 1, 2002, now U.S. Pat. No. 6,852,166, the entire contents of which are herein incorporated by reference.

BACKGROUND OF THE INVENTION

1. Field of the Invention

The present invention relates to a method of coating a cylindrical photoconductive element for use in an electrophotographic image forming apparatus and an apparatus therefore. More particularly, the present invention relates to a method capable of uniformly coating a conductive base with a liquid for forming a photoconductive layer and capable of coating a plurality of conductive bases with the liquid at the same time in a limited space, and an apparatus therefor.

2. Description of the Background Art

A photoconductive drum or similar photoconductive element for use in an electrophotographic image forming apparatus includes a cylindrical conductive base coated with a coating liquid that forms a photoconductive layer. For coating the conductive base with the coating liquid, use is generally made of a spray coater, a roll coater, a blade coater, a ring coater or similar coater or immersion coating. Among them, immersion coating holds the conductive base in a vertical position, dips the base in the coating liquid stored in a bath, and then lifts the base at a speed that sequentially varies to thereby form a photoconductive layer on the base.

More specifically, the above immersion coating generally includes a coating step, a peeling step, and a drying step. In the coating step, the conductive base is coated with the coating liquid that may additionally include an under layer forming liquid and a protection layer forming liquid. In the peeling step, needless portions of the photoconductive layer are peeled off the opposite end portions of the base. Subsequently, in the drying step, the photoconductive layer on the conductive base is dried either naturally or by heat, completing the photoconductive element.

To enhance productivity and reduce equipment cost, an immersion coating apparatus capable of saving space, and yet coating as great a number of conductive bases as possible at the same time, is required. Such an immersion coating apparatus has the following problem to be solved. The coating liquid contains a quick-drying solvent and therefore quickly dries and solidifies in a short period of time. However, during the interval between the lift of the conductive base away from the bath and drying to touch, the base is subjected to a light stream of air flowing therearound and to the vapor of the solvent produced from the photoconductive layer. Further, positioning a plurality of conductive bases in a limited space reduces a space available between nearby bases, so that each base is effected even by the flow of the vapor of the solvent produced from adjoining bases. In these conditions, the photoconductive layer or film formed on the individual base is irregular in thickness. An image forming apparatus using the resulting photoconductive drum brings about irregular density, background contamination and other defects in halftone images.

In light of the above, Japanese Patent No. 2,889,513 and Japanese Patent Laid-Open Publication No. 59-90662, for example, propose to arrange a windbreak on the top of a bath (scheme 1 hereinafter). Japanese Patent Laid-Open Publication Nos. 63-66560, for example, teaches a hood for enclosing a bath and cylindrical bodies (scheme 2 hereinafter). Japanese Patent Laid-Open Publication No. 7-144164, for example, proposes to lift bases together with a windbreak hood (scheme 3 hereinafter). Further, Japanese Patent Laid-Open Publication No. 63-7873, for example, proposes to mount a flexible hood on a base holder and immerse bases, which are enclosed by the hood, in a bath while sending air into the hood (scheme 4 hereinafter).

The scheme 1 is successful so long as the solvent of the coating liquid quickly dries to touch inside the windbreak. However, any delay in drying to touch disturbs the film thickness due to a light steam of air flowing above the windbreak. The scheme 2 has a problem that the hood must be large enough to enclose the entire bath, scaling up the equipment and increasing the cost. Another problem with the scheme 2 is that the vapor of a solvent is confined in the hood, causing much coating liquid to run down at the upper portion of each cylindrical body. The scheme 3 also needs a hood larger in size than the bath and higher than cylindrical bodies, scaling up equipment and increasing the cost. While the scheme 4 drives the vapor out of the hood via the bottom of the hood, it sends compressed air from a pump into the hood via the top of the hood. The compressed air therefore effects a film before the film dries to touch, resulting in irregular film thickness.

SUMMARY OF THE INVENTION

It is an object of the present invention to provide a coating method capable of uniformly coating a plurality of cylindrical bodies with a coating liquid at the same time in a limited space, and an apparatus therefore.

It is another object of the present invention to provide an image forming method capable of forming attractive images with a photoconductive element coated by the above method, and an apparatus therefor.

In accordance with the present invention, a coating method immerses a plurality of cylindrical bodies in a bath, which stores a coating liquid, at the same time and then lifts them to thereby form a film on each cylindrical body. The bath has a plurality of chambers each being positioned beneath one of the cylindrical bodies and storing the coating liquid. The cylindrical bodies each are positioned in a space that is closed at the top, surrounded by a flexible hood at the sides, and open at the bottom for discharging vapor of a solvent, which is contained in the coating liquid, produced during immersion or drying to touch. The cylindrical bodies are immersed in the coating liquid in the bath while being confined in the flexible hood. The cylindrical bodies and flexible hood are lifted together when the cylindrical bodies are lifted at a constant speed or a varying speed. The bottom of the hood is positioned, when the cylindrical bodies are brought to a stop after the lift, at a level coincident with or lower than the level of bottoms of the cylindrical bodies.

Also, in accordance with the present invention, a coating apparatus includes a supporting device including a holder support movable in the up-and-down direction. A plurality of holder members are affixed to the holder support for supporting a plurality of cylindrical bodies. A flexible hood is affixed to the holder support in such a manner as to surround the cylindrical bodies. The holder support is open at the bottom thereof for discharging the vapor of a solvent, which is contained in a coating liquid, produced during immersion or drying to touch. A bath is positioned below the supporting device and stores the coating liquid. The flexible hood folds or contracts at the top of the bath, rises together with the plurality of cylindrical bodies when the cylindrical bodies are lifted out of the bath at a constant speed or a varying speed, and has a bottom positioned at a level coincident with or below the level of the bottoms of the cylindrical bodies when the flexible hood is brought to a stop after the lift. The bath has a plurality of chambers each being positioned beneath one of the cylindrical bodies and each storing the coating liquid.

An image forming method and an image forming apparatus respectively using the above coating method and coating apparatus are also disclosed.

BRIEF DESCRIPTION OF THE DRAWINGS

The above and other objects, features and advantages of the present invention will become more apparent from the following detailed description taken with the accompanying drawings in which:

FIG. 13 is a table listing specific values of gaps D1 and D2 shown in FIGS. 2 and 3 and applied to Example 1 and Comparative Example 1;

FIG. 14 is a table listing conditions and the results of estimation relating to Example 1 and Comparative Example 1;

FIG. 15 is a table listing conditions and the results of estimation relating to Example 2 and Comparative Example 2; and FIG. 16 is a table listing conditions and the results of estimation relating to Example 3 and Comparative Example 3.

DESCRIPTION OF THE PREFERRED EMBODIMENT

Figure 1A:
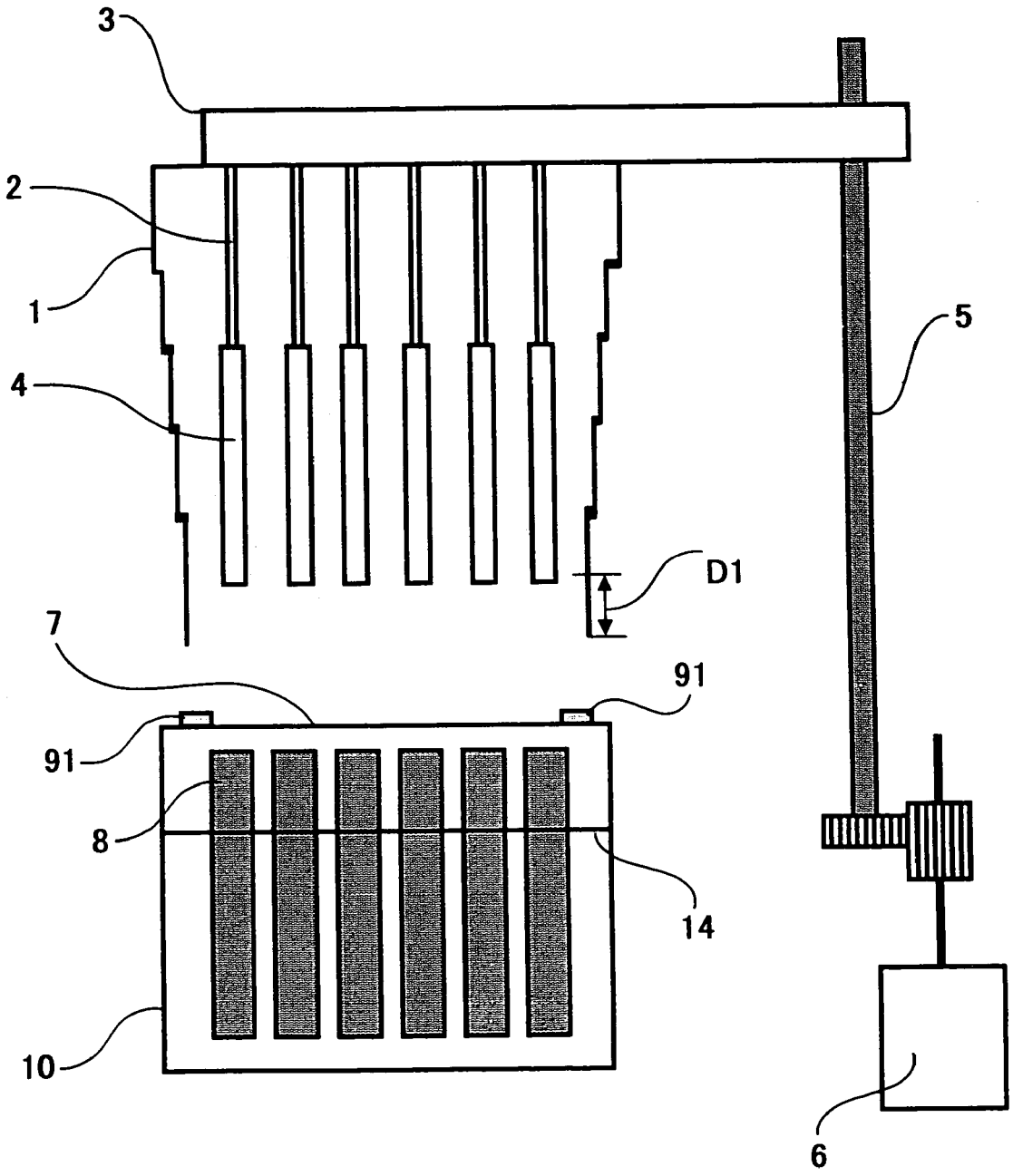
FIG. 1A is a view showing a condition before a plurality of cylindrical bodies are immersed in a coating liquid or after they have been lifted out of the coating liquid.

The present invention free from the problems discussed earlier will be described hereinafter. Fist, a coating method and an apparatus therefore in accordance with the present invention will be described.

Generally, in accordance with the present invention, a flexible hood is mounted on a holder support, which supports a plurality of cylindrical bodies, in such a manner as to surround the entire cylindrical bodies. The hood checks air and the vapor of a solvent, which is contained in a coating liquid, flowing around the cylindrical bodies. More specifically, the hood is affixed to the holder support, which is movable up and down, at its top and is open at its bottom. The hood is movable together with the cylindrical bodies. The cylindrical bodies each are retained in a vertical position by one of a plurality of holders affixed to the holder support.

The cylindrical bodies are immersed in a coating liquid, which is stored in a bath, at the same time within the flexible hood. The hood isolates the cylindrical bodies from a stream of air when the cylindrical bodies are lifted and drying to touch. Further, during drying to touch, the vapor of the solvent has uniform density around the individual cylindrical body and can flow down due to its own weight, insuring a uniform film on the cylindrical body.

The above coating procedure will be described more specifically with reference to 1A through 1C. As shown, the coating procedure handles twenty-four cylindrical bodies 4 at the same time by way of example; the cylindrical bodies 4 are arranged in a 4 (vertical)×6 (horizontal) matrix, as shown in FIG. 1C. A flexible hood 1 is affixed to a holder support 3, which supports a plurality of holders 2, and movable up and down together with the cylindrical bodies 4 (simply bodies 4 hereinafter). For example, a motor 6 causes the holder support 3, which supports the bodies 4, to move downward via a screw 5, so that the hood 1 is lowered together with the bodies 4. As soon as the bottom of the hood 1 abuts against, e.g., lugs 91 protruding from a stationary bath lid 7, the hood 1 starts folding or contracting. More specifically, the hood 1 shown in FIGS. 1A and 1B folds or contracts such that one piece thereof hides the outer surface of another piece immediately below it. Alternatively, one piece may hide the outer surface of another piece immediately above it.

Figure 2:
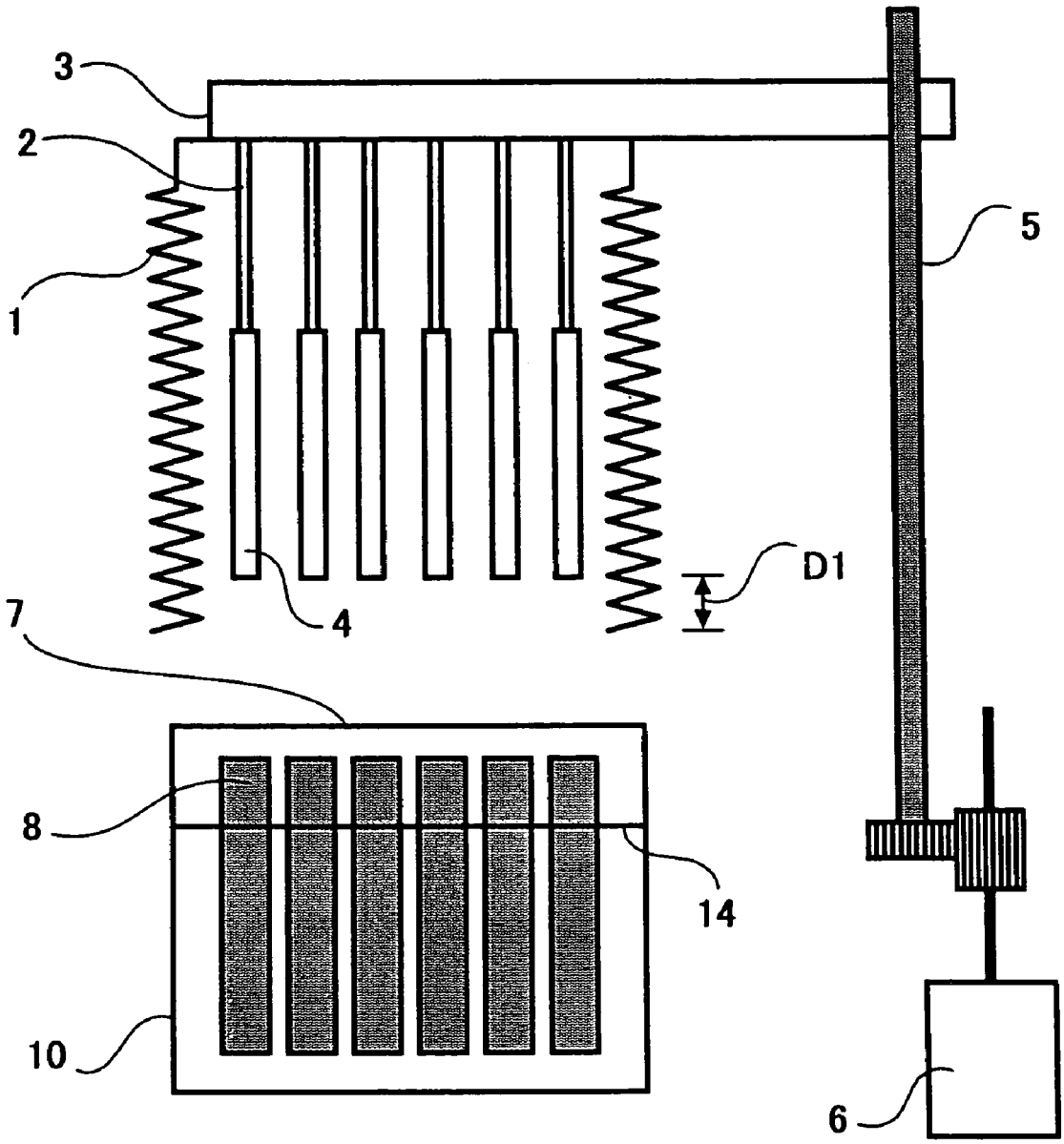
FIG. 2 is a view showing a coating method and a coating apparatus in accordance with the present invention.

FIG. 2 shows another specific configuration of the hood 1. As shown, the entire hood 1 is implemented as bellows. The bellows type hood 1 should preferably have its inner protruding edges held at a constant distance from the bodies 4. For this purpose, magnets may be fixed to the bottom of the hood 1, so that the bottom can be magnetically affixed to the bath lid 7. Further, the hood 1 may include spiral frame members resembling springs and covered.

Figure 1B:
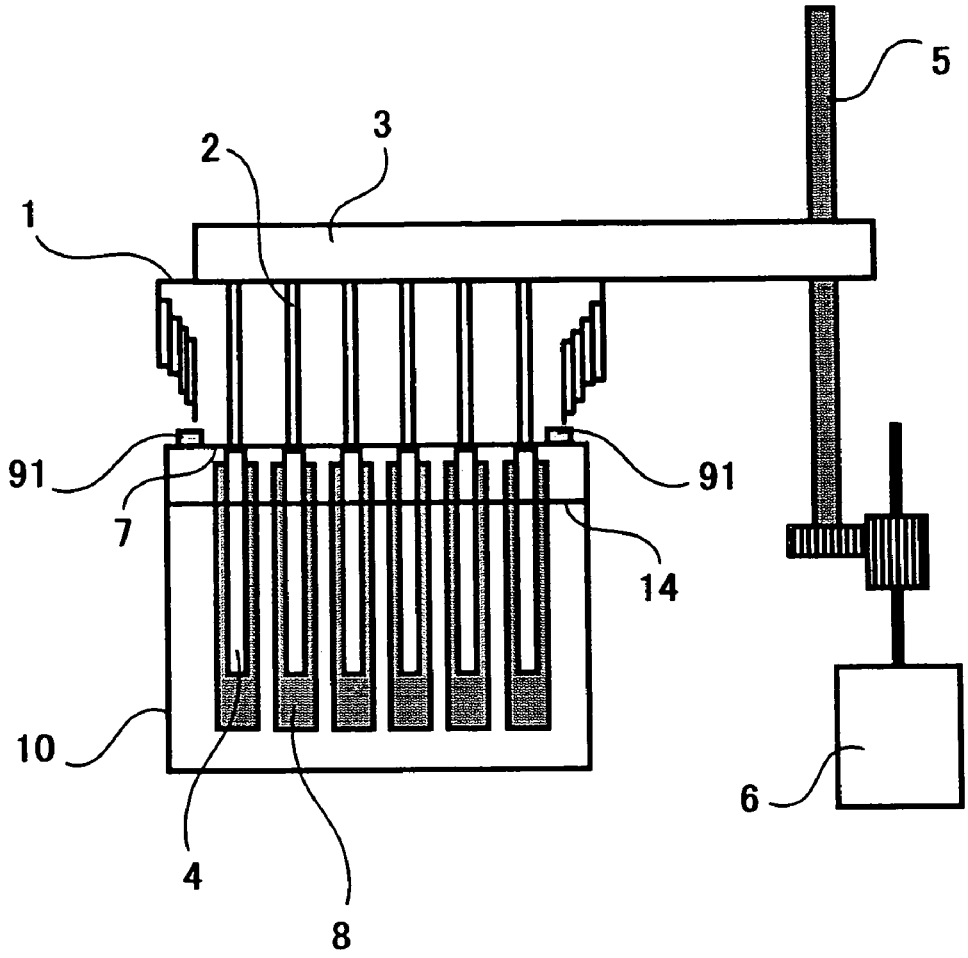
FIG. 1B is a view showing a condition in which the cylindrical bodies are immersed in the coating liquid.
Figure 1C:
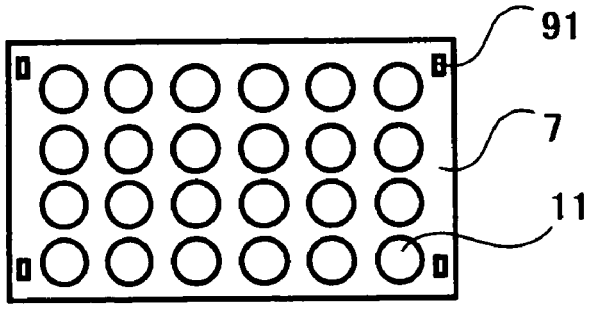
FIG. 1C is a plan view of a bath storing the coating liquid.

The flexible, foldable hood 1 shown in FIGS. 1A and 1B is particularly advantageous when consideration is given to positional accuracy between the hood 1 and the bodies 4.

As shown in FIGS. 1A and 1B, a bath 10 includes twenty-four chambers 8 each storing a coating liquid. When the bodies 4 are dipped in the coating liquid stored in the twenty-four chambers 8, the liquid overflowed the chambers 8 is collected and then returned to the chambers 8. A fresh coating liquid is replenished to the chambers 8 by an amount consumed by repeated coating.

At least one, preferably four, lugs 91 mentioned earlier are positioned at the four corners of the top of the bath lid 7. When the hood 1 folds or contracts on contacting the lugs 91, the lugs 19 form gaps between the hood 1 and the bath lid 7; the gaps correspond to the thickness of the lugs 91. In this condition, the bodies 4 are immersed in the coating liquid in the chambers 8 and then raised away from the chambers 8.

Figure 3A:
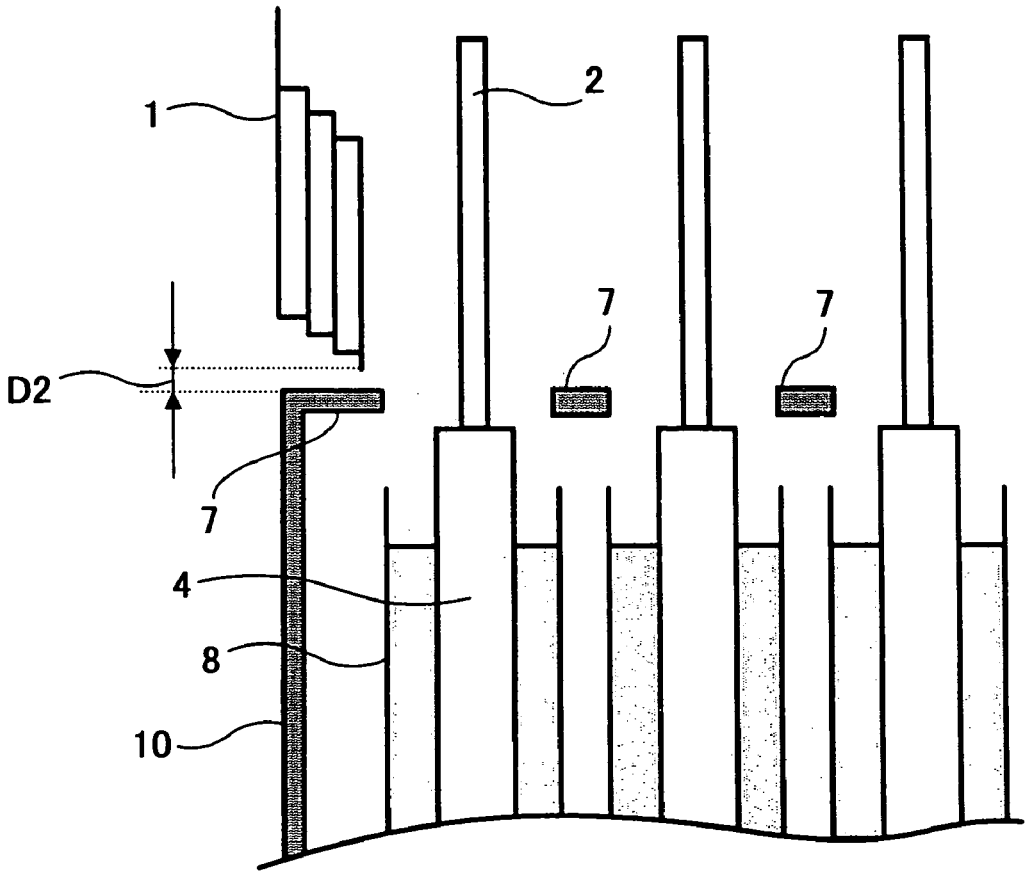
FIG. 3A is a fragmentary enlarged view showing a specific configuration of the upper end portion of the bath.
Figure 3B:
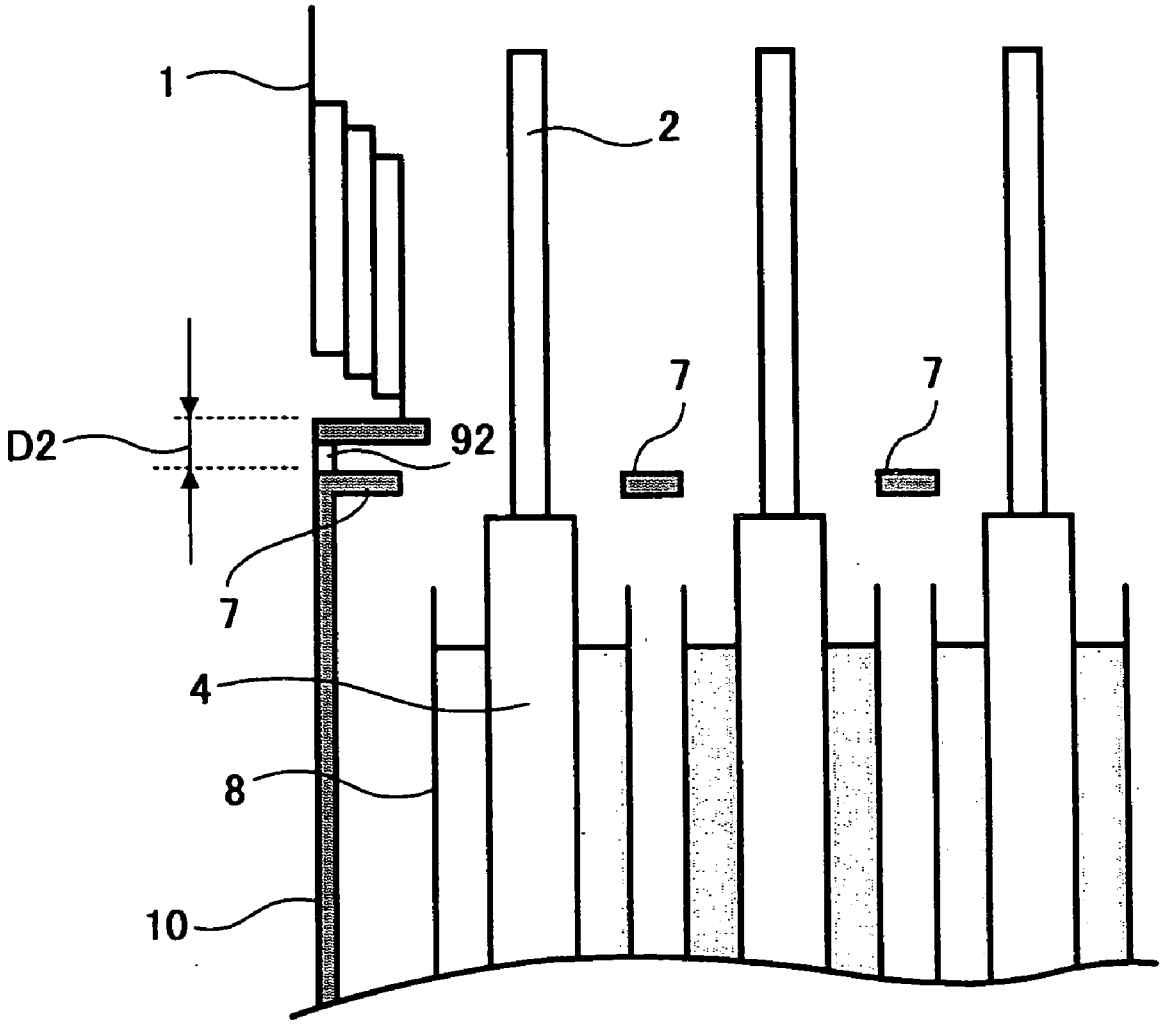
FIG. 3B is a view similar to FIG. 3A, showing another specific configuration of the upper end portion of the bath.

FIG. 3B shows another specific means for forming the gaps between the hood 1 and the bath 10. As shown, a plurality of holes 92 are formed in the upper portion of the side walls of the bath 10. The shape, size and so forth of each hole 92 may be suitably selected to implement desired gaps.

The food 1 may be formed of aluminum, stainless steel or similar metal highly resistive to solvents, nylon, polyethylene fluoride, polycarbonate, polyethylene, polypropylene or similar resin high resistive to solvents, glass or rubber. The hood 1 may have any desirable configuration so long as it surrounds all of the bodies 4. For example, as for the 4×6 arrangement of the bodies 4, the hood 1 may have a quadrilateral configuration.

The distance between the hood 1 and the bodies 4 should preferably be substantially equal to the distance between nearby bodies 4; more preferably, the former should be 0.8 times to 1.2 times as great as the latter. This successfully causes the vapor of the solvent to flow in the same manner between the outer bodies 4 and the hood 1 and between the other bodies 4 inside of the outer bodies 4 as far as possible. In this condition, all the bodies 4 can be effectively coated to the same thickness.

As shown in FIG. 1A, when the hood 1 is fully unfolded or extended after the lift away from the bath 10, the bottom of the hood 2 is held at a level equal to or lower than the level of the lower ends of the bodies 4. A difference D1 in level between the bottom of the hood 1 and the lower ends of the bodies 4 should preferably be 1 mm or above. Assume that during drying to touch that follows the lift of the bodies 4 away from the bath 10, the vapor of the solvent produced from the films of the bodies 4 flow downward due to its own weight and gathers at the bottom of the hood 1. Then, even a light stream of air at the bottom of the hood 1 would have critical influence on the degree of drying.

Assume that the bottom of the hood 1 is higher in level than the lower ends of the bodies 4 when fully unfolded. Then, part of each body 4 is exposed to the outside and causes the resulting film to be irregular. The difference D1 mentioned above is effective to reduce irregularity if 0 mm or above. However, if the difference D1 is excessively great, then the hood 1 must have its number of steps increased, scaling up the entire apparatus. From the space saving standpoint, the difference should preferably be about 100 mm or below, more preferably greater than or equal to zero mm, but smaller than or equal to 50 mm.

The present invention is particularly effective when the distance between nearby bodies 4 is 10 mm to 120 mm, more preferably 20 mm to 100 mm.

FIGS. 3A and 3B show the upper portion of the bath 10 in which the bodies 4 are immersed in the chambers 8. In FIG. 3A, the lugs 91 on the bath lid 7 are not shown. As shown, a gap D2 is formed between the top of the bath 10 and the bottom of the folded or contracted hood 1, as needed. The gap D2 should preferably be 1 mm to 50 mm, more preferably greater than or equal to 5 mm, but smaller than or equal to 25 mm. A gap D2 of 0 mm would cause the vapor of the solvent flown downward from the hood 1 due to its own weight stay at the bottom of the hood 1, varying the film thickness distribution from the top to the bottom of each body 4. A gap D2 above 50 mm would cause air corresponding in amount to the above vapor to flow out via the gap D2, also resulting in non-uniform film thickness.

Figure 4:
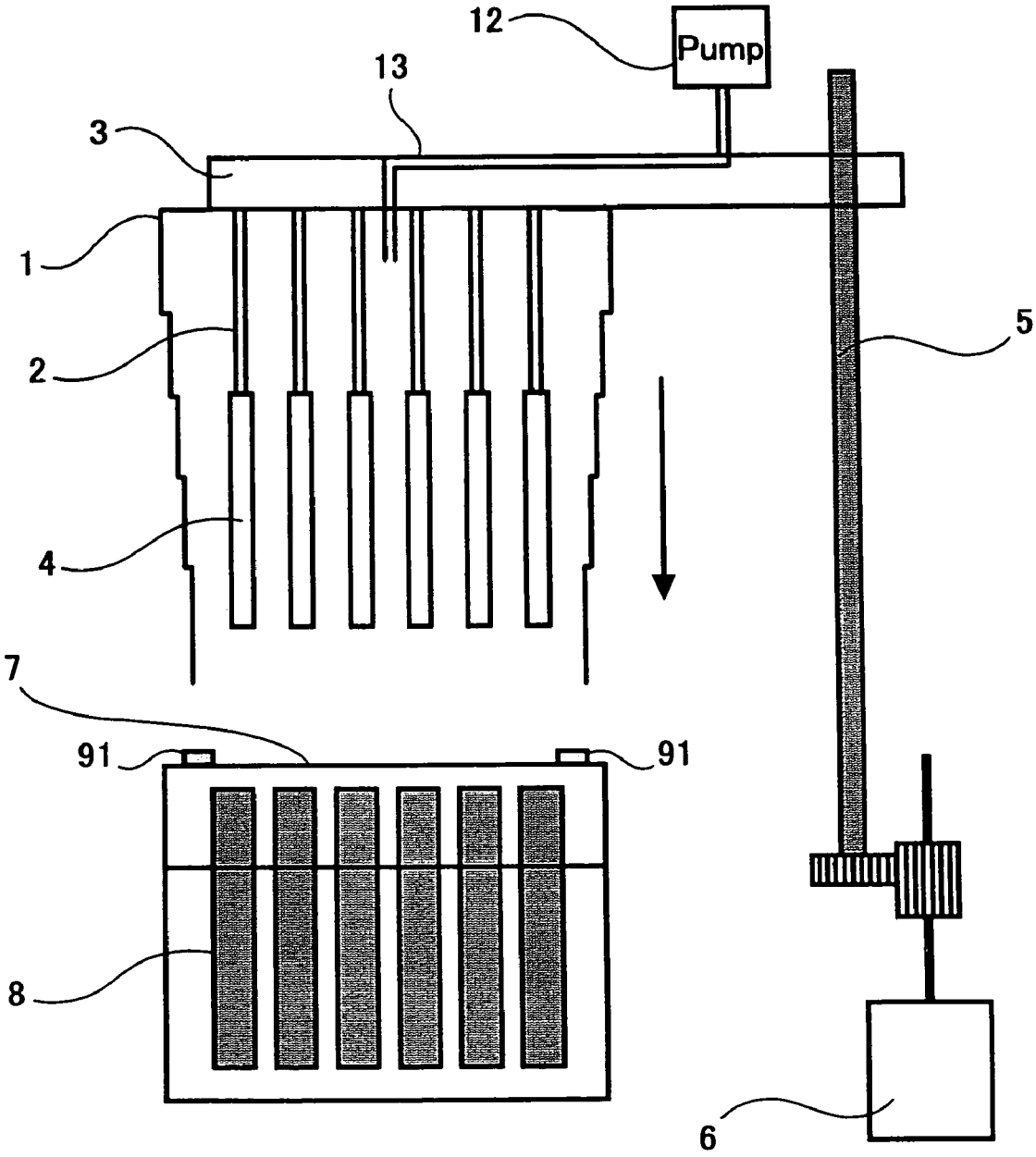
FIG. 4 is a view showing a condition before the immersion of the cylindrical bodies.

On the other hand, when a number of bodies 4 are continuously coated, the vapor of the solvent is apt to stay in a great amount in the hood 1. Such an amount of vapor delays the drying of the bodies 4 to touch and thereby reduces a margin as to irregular thickness. FIG. 4 shows an alternative arrangement additionally including an air pump 12. As shown, before the bodies 4 are immersed in the coating liquid, the air pump 12 sends compressed air or compressed inert gas into the hood 1 via a piping 13 so as to drive the vapor out of the hood 1. This successfully frees the bodies 4 from the influence of the vapor.

Figure 5:
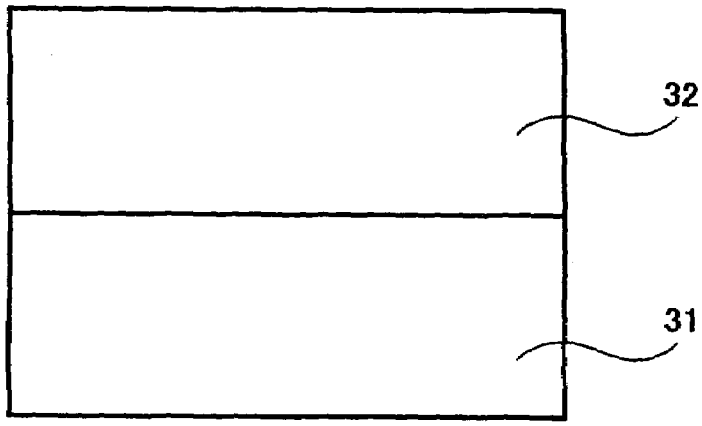
FIGS. 5 through 7 are sections each showing a particular specific configuration of a photoconductive element in accordance with the present invention.

FIG. 5 shows a specific configuration of a photoconductive element produced by the method or the apparatus of the present invention and applicable to an electrophotographic image forming apparatus. As shown, the photoconductive element is made up of a conductive base 31 and a single photoconductive layer 32 formed on the base 31 by use of a photoconductive layer coating liquid.

Figure 6:
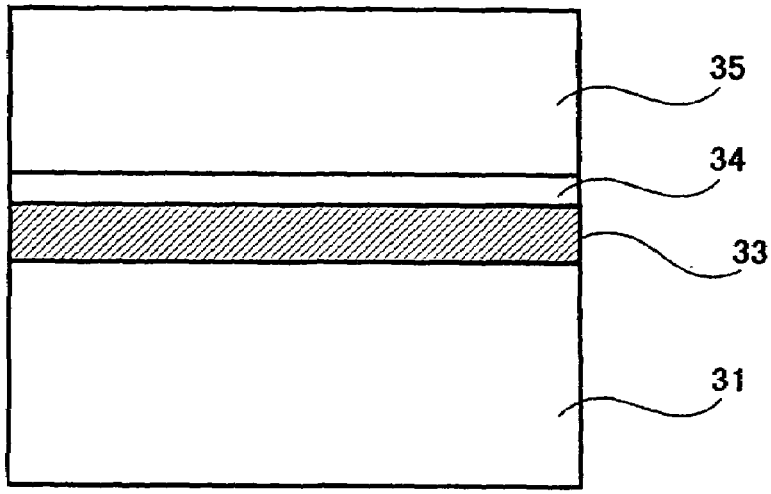

FIG. 6 shows another specific configuration of the photoconductive element. As shown, the photoconductive element includes a conductive base 31 and an under layer 33 formed on the base 31. A laminate photoconductive layer made up of a charge generation layer 34 and a charge transport layer 35 is formed on the under layer 33.

Figure 7:
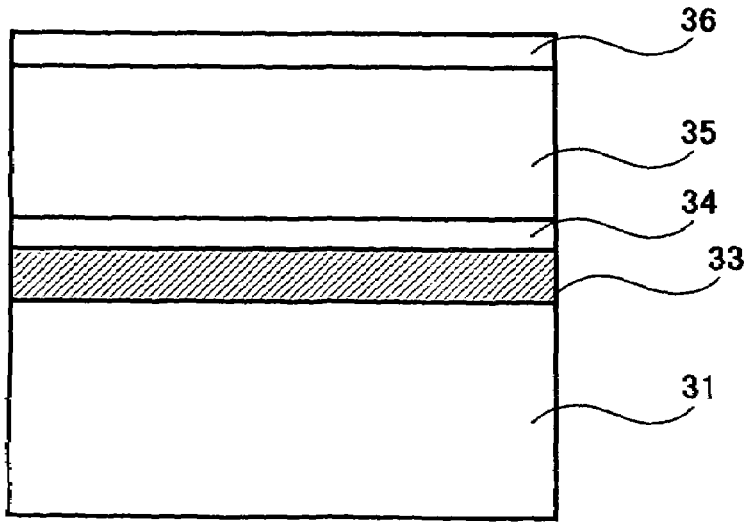

FIG. 7 shows still another specific configuration of the photoconductive element. As shown, the photoconductive element additionally includes a protection layer 36 formed on the charge transport layer 35 included in the configuration of FIG. 6. The configuration shown in FIG. 7 will be described first hereinafter.

To produce the conductive base 31, use may be made of a substance having volume resistivity of $10^{10}$ Ω·cm or below, e.g., aluminum, nickel, chromium, Nichrome, copper, gold, silver or platinum or similar metal or tin oxide, indium oxide or similar metal oxide. Such a substance is coated on a film or a cylinder of plastics or paper by vapor deposition or spattering. Alternatively, use may be made of an aluminum, aluminum alloy, nickel, stainless steel or similar sheet or a tube produced by, e.g., extrusion or pultrusion and cutting, superfinishing, polishing or similar finishing of the above sheet.

Further, for the support 31, an endless nickel belt or an endless stainless steel belt taught in Japanese Patent Laid-Open Publication No. 52-66016 may be used.

Moreover, conductive powder dispersed in suitable binder resin may be coated on the base 31. The conductive powder may be any one of carbon black, acetylene black, aluminum, nickel, iron, Nichrome, copper, zinc, silver and other metal powders, conductive titanium oxide, conductive tin oxide, ITO and other metal oxide powders, etc.

The binder resin may be any one of polystyrene, styrene-acrylonitrile copolymer, styrene-butadiene copolymer, styrene-maleic anhydride copolymer, polyester, polyvinyl chloride, poly(vinyl chloride-co-vinymeryl acetate), polyvinyl acetate, polyvinylidene chloride, polyarylate resin, phenoxy resin, polycarbonate, acetyl cellulose resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenol resin, alkyd resin and other thermoplastic resins, thermosetting resins and photosetting resins.

To form the conductive layer, the above conductive powder and binder resin may be dispersed in a suitable solvent, e.g., tetrahydrofuran, dichloromethane, 2-butanone or toluene and then coated.

The conductive base 31 may be implemented as a cylindrical base formed of polyvinyl chloride, polypropylene, polyester, polystyrene, polyvinylidene chloride, polyethylene, chlorinated rubber, polyethylene fluoride or similar substance. In this case, a tube containing the above-mentioned conductive powder and shrunk by heat is provided on the base as a conductive layer.

The under layer 33 contains a metal oxide for the purpose of, e.g., reducing residual potential. The metal oxide may be titanium oxide, aluminum oxide, silica, zirconium oxide, tin oxide or indium oxide or a combination of two or more of the metal oxides. Alternatively, use maybe made of a silane coupling agent, a titanium coupling agent, a chromium coupling agent, a titanyl kylate compound, a zirconium kylate compound, a titanyl alkoxide compound or an organic titanyl compound.

To form the under layer 33, a suitable solvent, dispersion and coating may be used as in the case of the photoconductive layer. Further, $Al_2O_3$ may be deposited by anodic oxidation. Alternatively, polyparaxylene or similar organic substance or $SiO_2$, $SnO_2$, $TiO_2$, ITO, $CeO_2$ or similar inorganic substance maybe deposited by a vacuum film forming method.

The binder resin contained in the under layer 33 may be polyvinyl alcohol, casein, sodium polyacrylate, copolymerized nylon, methoxymethyl nylon or similar thermoplastic resin or polyurethane, melamine, epoxy, alkyd, phenol, butyral, unsaturated polyester resin or similar thermosetting resin.

In the under layer 33, the ratio of the metal oxide (P) to the binder resin (R), i.e., P/R should preferably be between 0.9/1 to 2/1. If the ratio P/R is less than 0.9/1, then the characteristics of the binder resin effect the characteristics of the intermediate layer with the result that the characteristics of the entire photoconductive element noticeably vary due to varying temperature and humidity and repeated operation. If the ratio P/R is above 2/1, then many voids appear in the under layer 33 and obstruct close adhesion to the charge generation layer 34. Further, a ratio P/R above 3/1 would cause air to stay in the under layer 33 and form bubbles during drying.

The under layer 33 should preferably be 0.1 μm to 10 μm thick.

Charge generating substances applicable to the charge generation layer 34 include phthalocyanine pigments, monoazopigments, bis-azopigments, asymmetric dis-azo pigments, tris-azo pigments, tetra-azo pigments and other azo pigments, pyrrolopyrole pigments, anthraquinone pigments, perillene pigments, polycyclic quinone pigments, indigo pigments, pyren pigmentsk, diphenylmethane pigments, quinoline pigments, perinone pigments and other conventional substances. Two or more of such substances may be mixed together.

The binder resin for the charge generation layer 34 should preferably contain more than 50 wt % of butyral resin. If desired, butyral may be used together with, e.g., polyamide, polyurethane, epoxy resin, polyketone, polycarbonate, silicone resin, acrylic resin, polyvinyl formal, polyvinyl ketone, polystyrene, polyvinyl carbazol, polyacrylamide, polyvinyl benzal, polyester, phenoxy resin, poly(vinyl chloride-co-vinylmeryl acetate), polyvinyl acetate, polyamide, polyvinyl pyridine, cellulose resin, casein, polyvinyl alcohol or polyvinyl pyrrolidone.

The amount of the binder resin should be 10 parts by weight to 500 parts by weight, preferably 25 parts by weight to 300 parts by weight, for 100 parts by weight of the charge generating substance.

The solvent may be, e.g., isopropanol, acetone, methyl ethyl ketone, cyclohexane, tetrahydrofuran, dioxane, ethyl acetate, methyl acetate, dichloromethane, dichloroethane, monochlorobenzene, cyclohexane, toluene, xylene, and ligroin.

The charge generation layer 34 may be formed by a steps of dispersing the above substances in a suitable solvent by use of, e.g., a ball mill, an attritor, a sand mill or an ultrasonic wave, coating the dispersion on the intermediate layer, and drying it. The charge generation layer 34 should be 0.01 μm to 5 μm thick, preferably 0.1 μm to 2 μm thick.

A specific procedure for forming the charge transport layer 35 is dissolving or dispersing a charge transport substance and binder resin in a suitable solvent, coating the resulting mixture on the charge generation layer, and then drying it. A plasticizer, a leveling agent, an antioxidant and so forth may be added to the above mixture, as needed.

The solvent for the charge transport layer 35 may be any one of chloroform, tetrahydrofuran, dioxane, toluene, monochlorobenzene, dichloroethane, dichloromethane, cyclohexane, methyl ethyl ketone, acetone and so forth.

The charge transport layer 35 contains a hole transport substance and an electron transport substance. For the electron transport substance, use may be made of, e.g., chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4-8-trinitrothioxantone, 2,6,8trinitro-4H-indino[1,2-b]thiophene-4-on, 1,3,7-trinitrodibenzothiophene-5,5-dioxide, benzoquinone derivative or similar electron accepting substance.

For the hole transport substance, use may be made of, e.g., poly-N-vinylcarbazole or a derivative thereof, poly-γ-carbozol ethyl glutamate or a derivative thereof, pyrene-formaldehyde or a condensate or a derivative thereof, polyvinyl pyrene, polyvinyl phenanthrene, polysilane, an oxazole derivative, an oxydiazole derivative, an imidazole derivative, a monoarylamine derivative, a diarylamine derivative, a triarylamine derivative, a stilbene derivative, an α-phenylstilbene derivative, a bendizine derivative, a diarylmethane derivative, a triarylmethane derivative, a 9-styrylanthracene derivative, a pyrazoline derivative, a divinylbenzene derivative, a hydrozone derivative, an indene derivative, a butadiene derivative, a pyrene derivative, a bisstilben derivative, an enamine derivative or similar polymerized substance.

For the binder resin for the charge transport layer 35, use is made of thermoplastic resin or thermosetting resin, e.g., polystyrene, styrene-achrilonitrile copolymer, styrene-butadiene copolymer, styrene-maleic unhydride copolymer, polyester, polyvinyl chloride, vinyl chloride-vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin, alkyd resin or any one of polycarbonate copolymers taught in Japanese Patent Laid-Open Publication No. 6-51544.

The charge transport substance should be contained by 20 parts by weight to 300 parts by weight, preferably 40 parts by weight to 150 parts by weight, for 100 parts by weight of binder resin. The charge transport layer should preferably be about 5 μm to 50 μm thick.

A leveling agent and an antioxidant may be added to the charge transport layer 35. The leveling agent may be selected from silicone coil, e.g., dimethyl silicone coil or methyl phenyl silicone oil or a polymer or an oligomer having a perfluoroalkyl group at its side chain. The leveling agent should preferably be contained by 0 part by weight to 5 parts by weight for 100 parts by weight of binder resin.

The antioxidant may be any one of hindered phenol compounds, sulfur compounds, phosphor compounds, hindered amine compounds, pyridine derivatives, piperidine derivatives and morpholine derivatives. The antioxidant should preferably be contained by 0 part by weight to 5 parts by weight for 100 parts by weight of binder resin.

The protection layer 36 is implemented by, e.g., ultraviolet setting resin, electron beam setting resin or a thermosetting resin. Fluorocarbon resin, e.g., polytetrafluoroethylene, silicone resin, titanium oxide, tin oxide, potassium titanate or similar inorganic substance may be added to the protection layer 36 for enhancing wear resistance. Any conventional coating method is applicable to the protection layer 36. The protection layer 36 should preferably be 0.1 μm to 10 μm thick. If desired, a-C, a-SiC or similar conventional substance produced by the vacuum film forming method may be applied to the protection layer 36.

In accordance with the present invention, an intermediate layer, not shown, may be positioned between the charge transport layer 35 and the protection layer 36. Generally, the major component of the intermediate layer is resin, e.g., polyamide, nylon resin soluble in alcohol, butyral resin soluble in water, polyvinyl butyral or polyvinyl alcohol. The intermediate layer may also be formed by any conventional coating method and should preferably be 0.05 μm to 2 μm thick.

The charge generation layer 34 and charge transport layer 35 may be replaced each other, if desired. In such a case, the protection layer 36 should preferably be formed on the charge generation layer 34.

Figure 8:
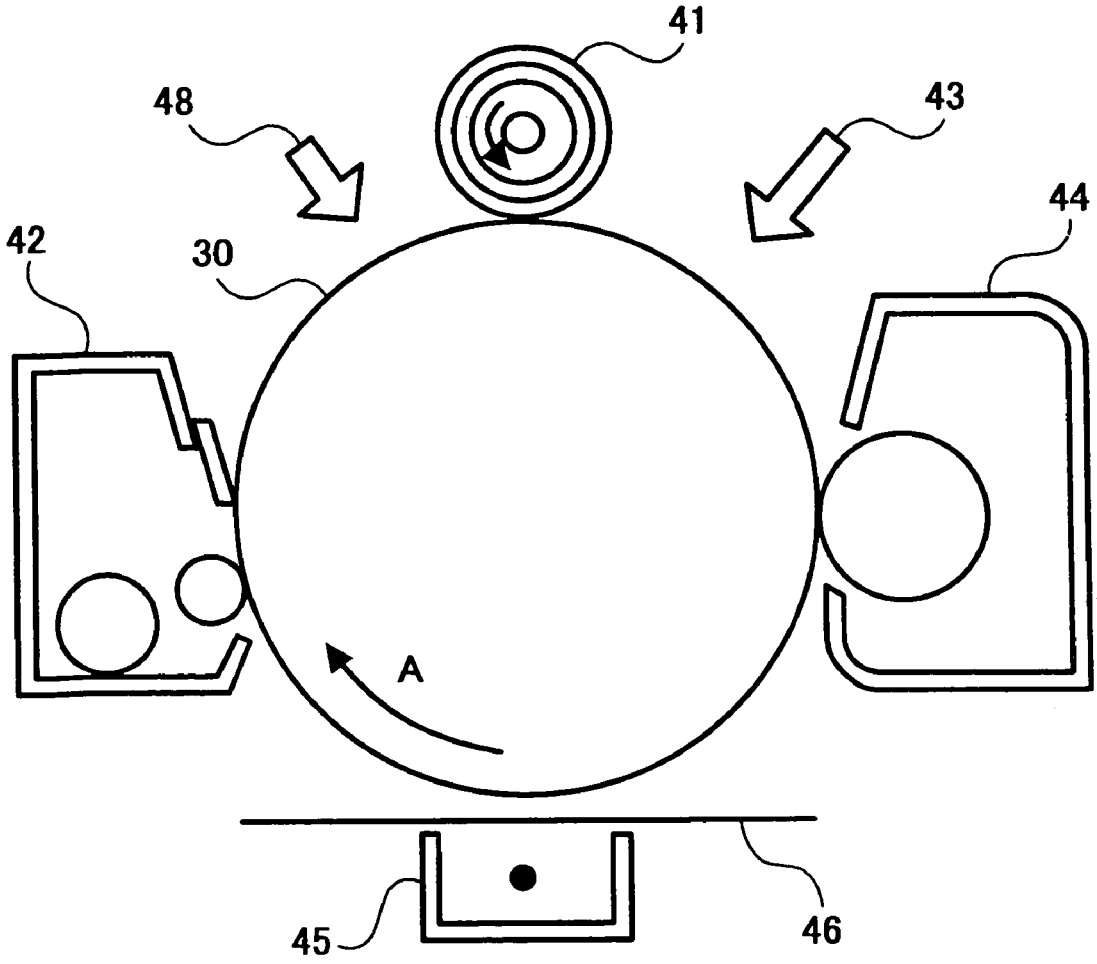
FIG. 8 is a view showing a specific configuration of an image forming apparatus in accordance with the present invention.
Figure 9:
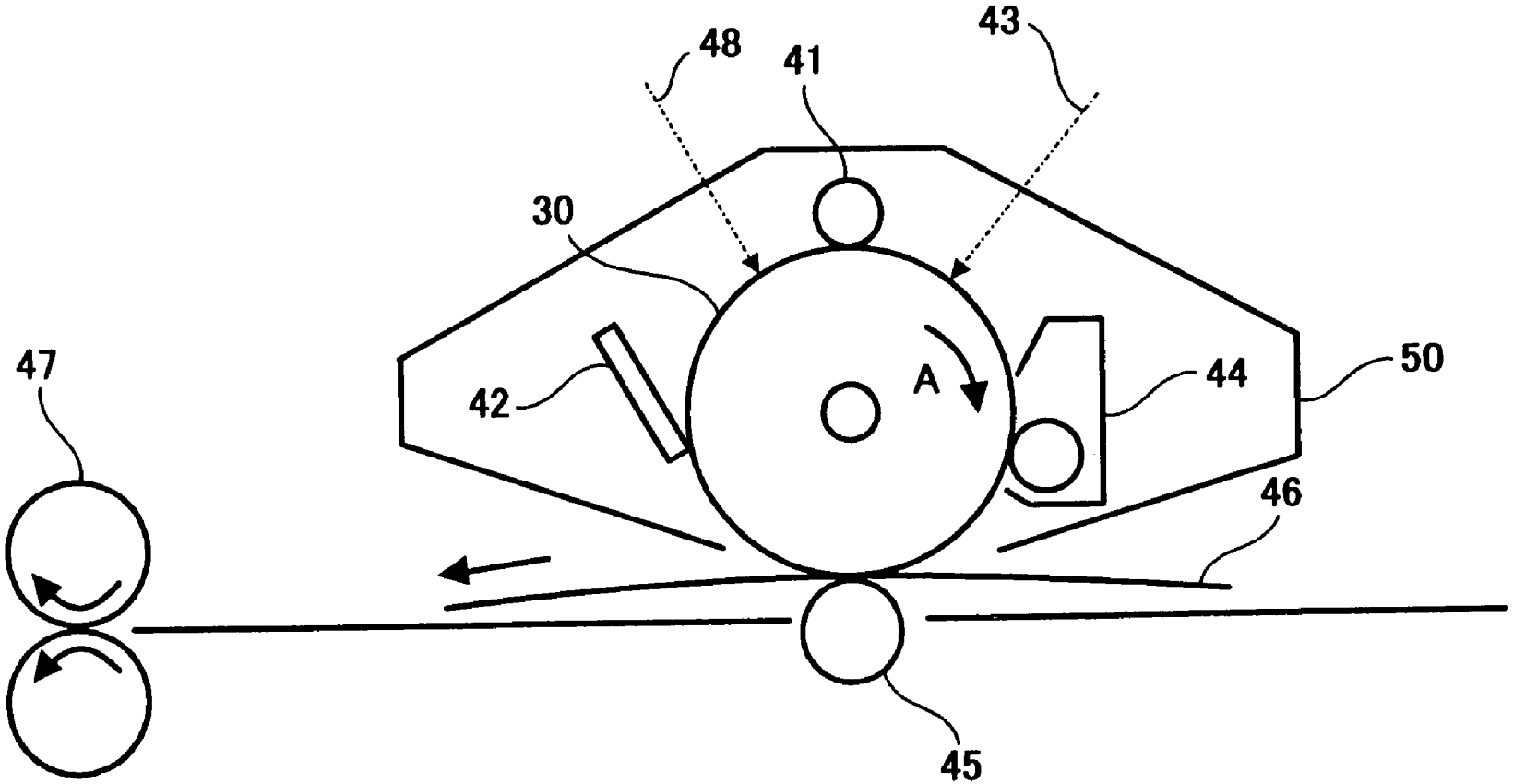
FIGS. 9 and 10 are views each showing a specific configuration of a process cartridge removably mounted to the image forming apparatus.
Figure 10:
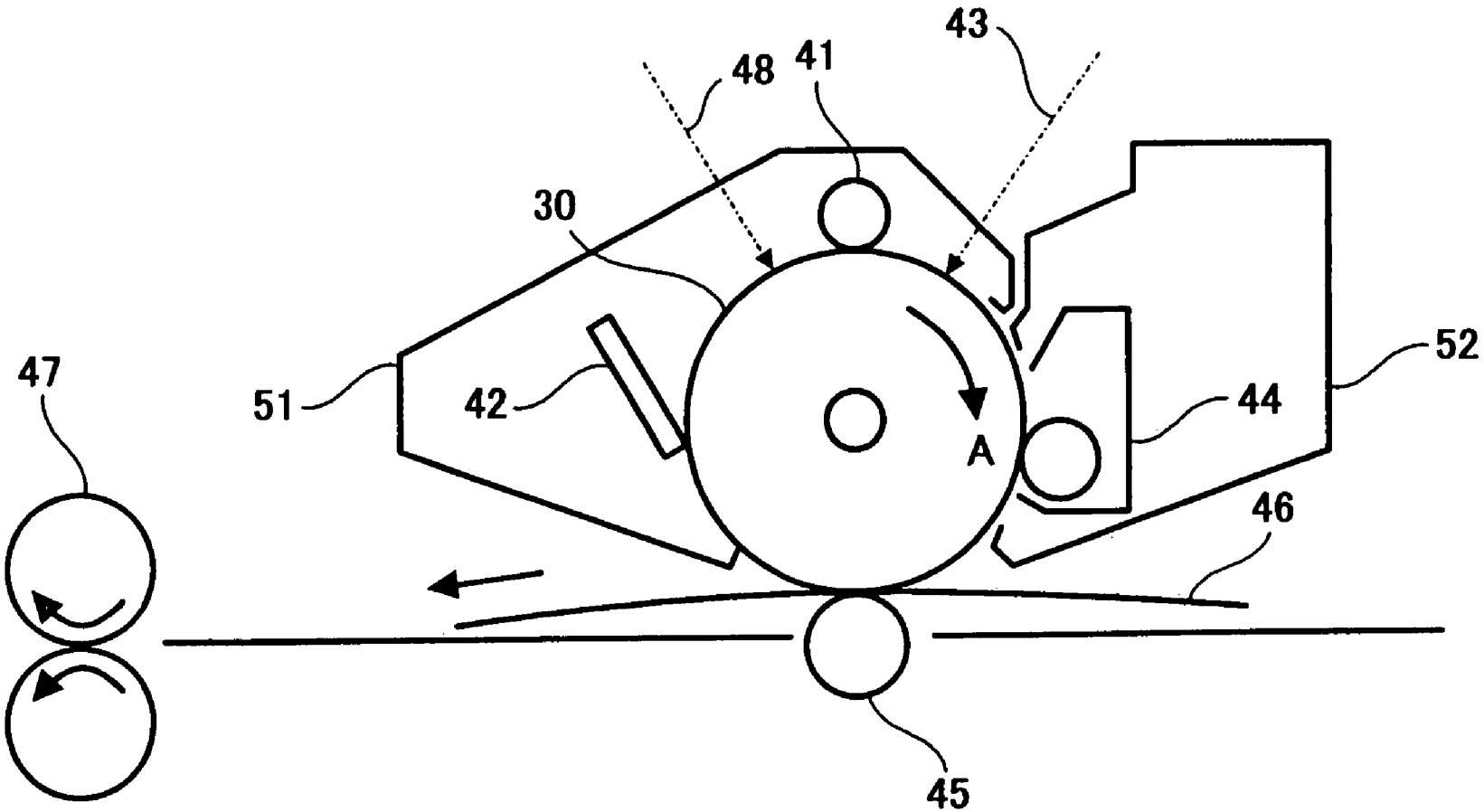

Reference will be made to FIGS. 8 through 10 for describing a method and an apparatus for image formation using the photoconductive element of the present invention. As shown in FIG. 8, a photoconductive element is implemented as a drum 30 rotatable in a direction A. A charger 41 charges the surface of the drum 30 in rotation to positive polarity or negative polarity.

Generally, a positive or a negative DC voltage is applied to the charger 41. The DC voltage is preferably −2,000 V to +2,000 V. Alternatively, an AC-biased DC voltage may be applied to the charger 41 for generating a pulse voltage. AC voltage to be superposed on DC voltage should preferably have a peak-to-peak voltage of 4,000 V or below. The AC voltage, however, sometimes causes the charger 41 and drum 30 to oscillate and produce noise. While the desired voltage may be instantaneously applied to the charger 41, it may be raised little by little in order to protect the drum 30.

A corotron charger or a scotoron charger spaced from a photoconductive element produces toxic ozone and nitrogen oxides, as well known in the art. By contrast, the charger 41 contacting the drum 30 produces a minimum of toxic gases although the non-contact type of charging scheme may be applied thereto.

However, the behavior of the non-contact type charger is noticeably dependent on the thickness of the charge transport layer of the photoconductive element, as also known in the art. That is, the absolute value of the charging voltage decreases with an increase in the thickness of the charge transport layer. More specifically, assume that the charge generation layer is uniform in thickness, but the charge transport layer is irregular in thickness. Then, the charge potential noticeably varies and directly effects halftone potential. As a result, irregular density, which reflects the irregularity of the thickness, appears in the resulting image. In accordance with the present invention, the drum 30 has a photoconductive element substantially free from irregularity in thickness and therefore allows a minimum of irregular density to occur.

The charger 41 may rotate in the same direction or in the opposite direction to the drum 30 or may simply slide on the circumference of the drum 30. The charger 41 may function to remove toner left on the drum 30 at the same time, in which case a drum cleaner 42 is not necessary.

An exposing device, not shown, exposes the charged surface of the drum 30 imagewise via a slit or with a laser beam 43, thereby forming a latent image on the drum 30. A developing device 44 develops the latent image with toner to thereby form a corresponding toner image. A sheet 46 is fed from a sheet feed section, not shown, to an image transfer position between the drum 30 and an image transferring device 45 in synchronism with the rotation of the drum 30. The image transferring device 45 transfers the toner image from the drum 30 to the sheet 46. A fixing device, not shown, fixes the toner image on the sheet 46. The sheet 46 with the fixed toner image is driven out to a copy tray.

After the image transfer from the drum 30 to the sheet 46, the drum cleaner 42 removes the toner left on the drum 30. Further, a discharger, not shown, discharges the cleaned surface of the drum 30 with light 48 to thereby prepare it for the next image forming cycle.

Two or more of the drum 30, developing device 44 and other components of the image forming apparatus may be constructed into a single process cartridge removably mounted to the image forming apparatus. FIG. 9 shows a specific process cartridge having a casing 50 in which the drum 30, charger 41 and developing device 44 are accommodated. Rails or similar guide means are mounted on the apparatus to allow the process cartridge to be pulled out of the apparatus. The drum cleaner 42 may be additionally disposed in the casing 50.

FIG. 10 shows two process cartridges removably mounted to the apparatus. As shown, a first process cartridge has a casing 51 accommodating the drum 30 and charger 41 while a second process cartridge has a casing 52 accommodating the developing device 44. The drum cleaner 42 may be additionally disposed in the casing 51.

The image transferring device 45 shown in FIGS. 9 and 10 may have the same configuration as the charger 41. A DC voltage of 400 V to 2,000 V should preferably be applied to the image transferring device 45. In FIGS. 9 and 10, The reference numeral 47 designates a fixing device.

The charger 41 maybe implemented as a roller, a brush, a blade or a flat plate by way of example. The charger 41 implemented as a roller, i.e., a charge roller 41 will be described specifically hereinafter.

The charge roller 41 is made up of a rod-like conductive core and an elastic layer, a conductive layer and a resistance layer sequentially laminated on the core. For the conductive core, use may be made of iron, copper, stainless steel or similar metal or resin with carbon or metal grains dispersed therein or similar conductive resin. The core may either by a rod or a plate by way of example.

The elastic layer of the charge roller 41 is highly elastic and should preferably be 1.5 mm thick or above, preferably 2 mm or above or more preferably 3 mm to 13 mm thick. The elastic layer may be formed of, e.g., chloroprene rubber, isoprene rubber, EPDM rubber, polyurethane, epoxy rubber or butyl rubber.

The conductive layer is highly conductive and should have volume resistivity of $10^7$ Ω·cm or below, preferably $10^6$ Ω·cm or below or more preferably $10^{-2}$ Ω·cm to $10^6$ Ω·cm. To transfer the flexibility of the underlying elastic layer to the overlying resistance layer, the conductive layer should preferably be as thin as 3 mm or below, more preferably 2 mm or below or particularly 30 μm to 1 mm. The conductive layer may be implemented by a metal film formed by vapor deposition, resin with conductive grains dispersed therein, and conductive resin. For the metal film, use may be made of aluminum, indium, nickel, copper or iron by way of example. For the resin with conductive grains dispersed therein, use made be made of urethane, polyester, vinyl acetate-vinyl chloride copolymer or poly(methyl methacrylate) in which grains of carbon, aluminum, nickel, titanium oxide or similar conductive metal are dispersed. The conductive resin may be any one of, e.g., poly(methyl methacrylate) containing quaternary ammonium salt, polyvinyl aniline, polyvinyl pyrol, polydiacethylene and polyethylene imine.

The resistance layer has higher resistance than the conductive layer. The volume resistivity of the resistance layer should preferably be $10^6$ Ω·cm to $10^{12}$ Ω·cm, more preferably $10^7$ Ω·cm to $10^{11}$ Ω·cm. For the resistance layer, use may be made of semiconductive resin or insulative resin with conductive grains dispersed thereon. Typical of conductive resin are ethyl cellulose, nitrocellulose, methoxymethyl nylon, copolymerized nylon, polyvinyl pyrrolidone and casein or mixtures thereof. The insulative resin with conductive grains dispersed therein may be urethane, polyester, vinyl acetate-vinyl chloride copolymer, polymethacrylic acid or similar resin in which grains of carbon, aluminum, indium oxide, titanium oxide or similar conductive metal are dispersed in a small amount for adjusting resistance. The resistance layer should preferably be 1 μm to 500 μm, particularly 50 μm to 200 μm, from the conductivity standpoint.

As for a flat plate for the charger 41, the elastic layer and resistance layer are laminated on a metal plate.

As for a brush for the charger 41, conductive filaments may be adhered to a conductive core via an adhesive layer in such a manner as to extend radially outward from the core. Alternatively, the conductive layer may be adhered to one major surface of a metal plate via an adhesive layer. The conductive filaments have high electric conductivity and have volume resistivity of $10^3$ Ω·cm or below, preferably $10^6$ Ω·cm or below or more preferably $10^{-2}$ Ω·cm to $10^6$ Ω·cm. Each conductive filament should preferably have a small diameter so as to be flexible. The diameter is between 1 μm and 100 μm, preferably between 5 μm and 50 μm or more preferably between 8 μm and 30 μm. The length of the individual filament should preferably be 2 mm to 10 mm or more preferably 3 mm to 8 mm. The filaments may be formed of the previously mentioned resin with conductive grains dispersed therein or the conductive resin or may be formed of carbon.

Examples of the present invention and comparative examples will be described hereinafter.

EXAMPLE 1 AND COMPARATIVE EXAMPLE 1

To prepare a coating liquid for the under layer, 50 parts of weight of titanium oxide CREL (trade name) available from ISHIHARA SANGYO KAISHA, LTD., 15 parts by weight of alkyd resin BECKOLITE (trade name; 50 wt % of solids) available from DAINIPPON INK & CHEMICALS, INC., 10 parts by weight of melamine resin SUPER BECKAMINE (trade name; 60 wt % of solids) also available from DAINIPPON INK & CHEMICALS, INC. and 100 parts by weight of methyl ethyl ketone were dispersed in a ball mill for 72 hours.

Figure 11:
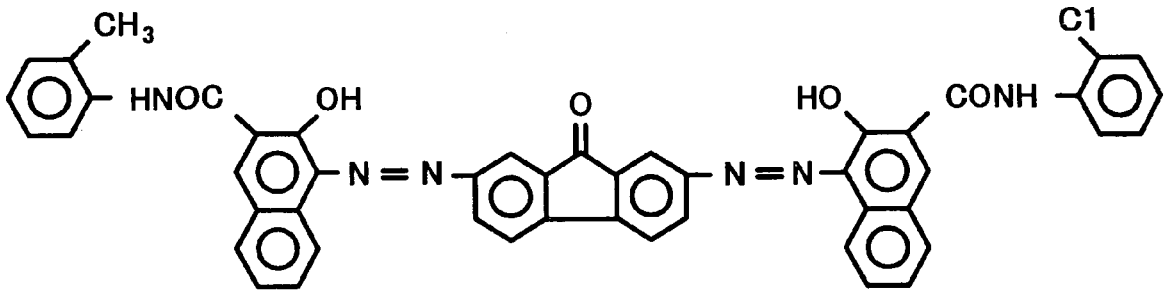
FIGS. 11 and 12 show chemical formulae each representing a particular substance applicable to the present invention.
Figure 12:
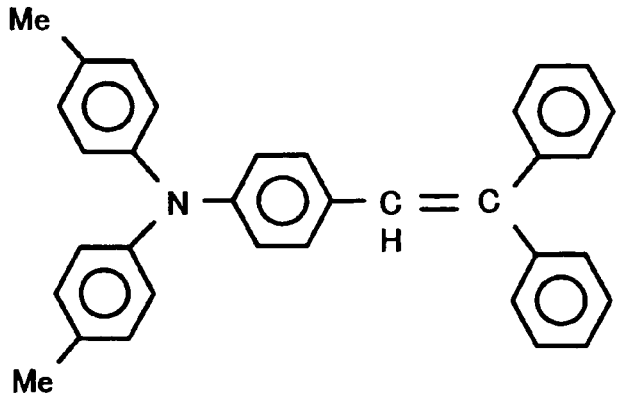

To prepare a coating liquid for the charge generation layer, 15 parts by weight of type A titanyl phthalocyanine, 15 parts by weight of disazo pigment represented by a formula shown in FIG. 11 and 12.5 parts by weight of ion exchange water were dispersed in 300 parts by weight of cyclohexanone in a ball mill for 192 hours. After the dispersion, a resin liquid with 4 parts by weight of polyvinyl butyral ESREC BX-1 (trade name) available from Sekisui Chemical Co., Ltd. dispersed in 300 parts by weight of methyl ethyl ketone and 1,680 parts by weight of cyclehexanone was added to and then dispersed together for 3 hours.

To prepare a coating liquid for the charge transport layer, 8 parts by weight of a charge transport substance represented by a formula shown in FIG. 12, 10 parts by weight of polycarbonate (type Z; viscosity mean molecular weight of 50,000) and 0.002 part by weight of silicone oil KF-50 available from Shin-Etsu Chemical Co., Ltd. were dissolved in 100 parts by weight of tetrahydrofuran.

An aluminum drum with a diameter of 30 mm and a length of 340 mm was immersed in the under layer coating liquid and then dried at 130° C. for 20 minutes to form a 4 μm thick intermediate layer. The drum with the under layer was sequentially immersed in the charge generation layer coating liquid and charge transport layer coating liquid in this order, completing a photoconductive element. A charge generation layer and a charge transport layer were respectively 0.2 μm thick and 309 μm thick, and each were dried at 180° C. for 30 minutes.

The apparatus shown in FIGS. 1A through 1C was used to produce the above photoconductive element. The apparatus produced twenty four (4×6) photoconductive elements at the same time, as described with reference to FIG. 1C. The distance D1, FIG. 1A, and distance D2, FIGS. 3A and 3B, were varied to prepare Examples 1-1 through 1-8 and Comparative Examples 1-1 and 1-2 shown in FIG. 13.

An eddy current type of film thickness gauge Fischer 560 c (trade name) available from Fischer was used to measure the total thickness of the under layer, charge generation layer and charge transport layer. The measurement was effected at three points remote from the top of the drum by 50 mm, 170 mm and 290 mm in the axial direction. At each of these points, film thickness was measured at twelve points in the circumferential direction at the intervals of 30°. Subsequently, a difference R between the maximum thickness and the minimum thickness was calculated to estimate uniformity. As for uniformity in the axial direction, a difference (slope) between thickness at 50 mm and thickness at 290 mm was determined with the circumferential direction fixed. Thereafter, the drum was mounted to a copier Imagio MF2730 (trade name) available from RICOH CO., LTD. The copier was then operated to output halftone images and trimmed images. It is to be noted that the above copier uses the contact type of charging system using a charge roller. FIG. 14 lists the above conditions and the results of estimation; circles indicate "good".

As FIG. 14 indicates, in Examples 1-1 through 1-8, gaps D1 greater than or equal to 0 mm effectively reduce irregular film thickness in the circumferential direction, particularly at the bottom of the drum. Gaps D2 greater than or equal to 1 mm, but smaller than or equal to 50 mm, obviate the slope of the thickness distribution in the axial direction as well, i.e., make the distribution flat.

By contrast, in Comparative Example 1, the film thickness has a slope at the upper end of the support and includes an extremely small portion. A trimmed image had its upper end smeared while a halftone image was irregular in density due to the irregular thickness of the photoconductive layer.

EXAMPLE 2

Immersion coating was repeated fifteen times under the same conditions as in Examples 1-1 through 1-8 without feeding compressed air. Photoconductive elements coated by the fifteenth coating step were used as Examples 2-1 through 2-8. FIG. 15 shows the conditions of Example 2 and the results of estimation. As shown, irregularity in film thickness and slope in the axial direction were aggravated due to the vapor of solvent contained in the coating liquid.

EXAMPLE 3

Example 3 was conducted in the same conditions as Example 1 while using compressed air. Specifically, before the immersion of the conductive bases in the coating liquid, the air pump 12, FIG. 4, was driven to feed a sufficient amount of compressed air (greater than the volume inside the hood 1). Thereafter, the bases were immersed in the coating liquid. The procedure was repeated fifteen times. The drums coated by the fifteenth coating procedure were used as Examples 3-1 through 3-8 and estimated in the same manner as in Examples 1-1 through 1-8. The hood 1 has the same configuration in both of Examples 1-1 through 1-8 and Examples 3-1 through 3–8. FIG. 16 lists the results of estimation. As shown, the result of the fifteenth procedure was comparable with the result of the first procedure because of compressed air, which was fed after each time of immersion.

In summary, it will be seen that the present invention provides a method and an apparatus capable of uniformly coating a cylindrical body with a coating liquid and coating a plurality of cylindrical bodies with the liquid at the same time in a limited space. More specifically, a uniform photoconductive layer can be formed on a conductive base, implementing a photoconductive element insuring images free from defects. A method and an apparatus for image formation using such a photoconductive element contribute a great deal to the imaging art.

Various modifications will become possible for those skilled in the art after receiving the teachings of the present disclosure without departing from the scope thereof.

What is claimed is:

1. In a method of immersing a plurality of cylindrical bodies in a bath, which stores a coating liquid, at the same time and then lifting said plurality of cylindrical bodies to thereby form a film on each cylindrical body, said bath comprises a plurality of chambers each being positioned beneath one of said plurality of cylindrical bodies and storing said coating liquid, the plurality of cylindrical bodies are positioned in a space that is closed at a top, surrounded by a flexible hood at sides, and open at a bottom for discharging vapor of a solvent, which is contained in the coating liquid, produced during immersion or drying to touch, the plurality of cylindrical bodies are immersed in the coating liquid in the bath while being confined in said flexible hood, the plurality of cylindrical bodies and said flexible hood are lifted together when said plurality of cylindrical bodies are lifted at a constant speed or a varying speed, and the bottom of said flexible hood is positioned, when the plurality of cylindrical bodies are brought to a stop after a lift, at a level coincident with or lower than a level of bottoms of said plurality of cylindrical bodies.

2. The method in accordance with claim 1, wherein when said cylindrical bodies are brought to a stop, a difference in level between the bottom of said flexible hood and the bottoms of said cylindrical bodies is between 1 mm and 100 mm.

3. The method in accordance with claim 1, wherein before immersion of the cylindrical bodies in the coating liquid, air or an inert gas under pressure is sent into said flexible hood to thereby drive the vapor of the solvent out of aid flexible hood.

4. The method in accordance with claim 3, wherein when said cylindrical bodies are brought to a stop, a difference in level between the bottom of said flexible hood and the bottoms of said cylindrical bodies is between 1 mm and 100 mm.

5. The method as claimed in claim 1, wherein when said flexible hood is folded or contracted, a difference between the bottom of said hood, which is open, and a top of said bath is between 1 mm and 50 mm.

6. The method in accordance with claim 5, wherein before immersion of the cylindrical bodies in the coating liquid, air or an inert gas under pressure is sent into said flexible hood to thereby drive the vapor of the solvent out of aid flexible hood.

7. The method in accordance with claim 6, wherein when said cylindrical bodies are brought to a stop, a difference in level between the bottom of said flexible hood and the bottoms of said cylindrical bodies is between 1 mm and 100 mm.

* * * * *